US005124028A

United States Patent [19]

Klimpel

[11] Patent Number: 5,124,028

[45] Date of Patent: Jun. 23, 1992

[54] FROTH FLOTATION OF SILICA OR SILICEOUS GANGUE

[75] Inventor: Richard R. Klimpel, Midland, Mich.

[73] Assignee: The Dow Chemical Company, Midland, Mich.

[21] Appl. No.: 546,167

[22] Filed: Jun. 28, 1990

[51] Int. Cl.[5] ..... B03D 1/01; B03D 1/02

[52] U.S. Cl. ..... 209/166; 209/167; 252/61

[58] Field of Search ..... 209/166, 167, 902; 252/61

[56] References Cited

U.S. PATENT DOCUMENTS

| | | | |
|---|---|---|---|
| 1,102,874 | 7/1914 | Chapman | 209/166 |
| 2,014,405 | 9/1935 | Weed | 209/166 |
| 2,074,699 | 3/1937 | Lenher et al. | 209/166 |
| 2,173,909 | 9/1939 | Kritchevsky | 209/166 |
| 2,177,985 | 10/1939 | Harris | 209/166 |
| 2,182,845 | 12/1939 | Harris | 209/166 |
| 2,335,485 | 11/1943 | Christmann | 209/166 |
| 2,377,129 | 5/1945 | Christmann et al. | 209/166 |
| 2,385,819 | 10/1945 | Lamb | 209/166 |
| 4,081,363 | 3/1978 | Grayson | 209/166 |
| 4,110,207 | 8/1978 | Wang et al. | 209/166 |
| 4,139,482 | 2/1979 | Holme | 252/61 |
| 4,158,623 | 6/1979 | Wang et al. | 209/166 |
| 4,172,029 | 10/1979 | Hefner, Jr. | 209/166 |
| 4,276,156 | 6/1981 | Hefner, Jr. | 209/166 |
| 4,287,052 | 9/1981 | Hefner | 209/166 |
| 4,507,198 | 3/1985 | Unger et al. | 209/166 |
| 4,732,667 | 3/1988 | Hellsten | 209/166 |
| 4,830,739 | 5/1989 | Hellsten | 209/166 |

FOREIGN PATENT DOCUMENTS

| | | | |
|---|---|---|---|
| 378252 | 8/1971 | U.S.S.R. . | |
| 649469 | 6/1977 | U.S.S.R. . | |
| 1050751 | 5/1982 | U.S.S.R. . | |
| 1058136 | 4/1985 | U.S.S.R. . | |
| 1461514 | 11/1986 | U.S.S.R. | 209/166 |
| 1356915 | 6/1974 | United Kingdom . | |

*Primary Examiner*—Stanley S. Silverman
*Assistant Examiner*—Thomas M. Lithgow

[57] ABSTRACT

Silica and siliceous gangue are separated from desired mineral values, particularly iron and phosphate, by reverse froth flotation in the presence of amine collectors and effective amounts of alkanol amines such as diethanol amine.

7 Claims, No Drawings

FROTH FLOTATION OF SILICA OR SILICEOUS GANGUE

BACKGROUND OF THE INVENTION

This invention is related to reverse flotation processes wherein silica or siliceous gangue is floated.

Flotation is a process of treating a mixture of finely divided mineral solids, e.g., a pulverulent ore, suspended in a liquid whereby a portion of the solids is separated from other finely divided mineral solids, e.g., silica, siliceous gangue, clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

The minerals and their associated gangue which are treated by froth flotation generally do not possess sufficient hydrophobicity or hydrophilicity to allow adequate separation. Therefore, various chemical reagents are often employed in froth flotation to create or enhance the properties necessary to allow separation. Collectors are used to enhance the hydrophobicity and thus the floatability of different mineral values. Collectors must have the ability to (1) attach to the desired mineral species to the relative exclusion of other species present: (2) maintain the attachment in the turbulence or shear associated with froth flotation; and (3) render the desired mineral species sufficiently hydrophobic to permit the required degree of separation.

A number of other chemical reagents are used in addition to collectors. Examples of types of additional reagents used include frothers, depressants, pH regulators, such as lime and soda, dispersants and various promoters and activators. Depressants are used to increase or enhance the hydrophilicity of various mineral species and thus depress their flotation. Frothers are reagents added to flotation systems to promote the creation of a semi-stable froth. Unlike both depressants and collectors, frothers need not attach or adsorb on mineral particles. Promoters and activators increase or enhance the effectiveness of other reagents such as collectors or depressants.

Froth flotation has been extensively practiced in the mining industry since at least the early twentieth century. In the typical or direct flotation scheme, the valuable or desired mineral is floated away from the gangue material which is left in the tailings. In another type of flotation scheme called reverse flotation, the undesired mineral, such as silica or siliceous gangue is floated away from the valuable minerals which are left in the tailings.

A wide variety of compounds are taught to be useful as collectors, frothers and other reagents in froth flotation. For example, in reverse flotation where silica or siliceous gangue is floated away from valuable minerals, amines such as simple primary and secondary amines, primary ether amines and ether diamines, tallow amines and tall oil fatty acid/amine condensates are generally accepted as useful collectors. Reagents useful as frothers include lower molecular weight alcohols such as methyl isobutyl carbinol and glycol ethers. The specific additives used in a particular flotation operation are selected according to the nature of the ore, the conditions under which the flotation will take place, the mineral sought to be recovered and the other additives which are to be used in combination therewith.

It is recognized that the effectiveness of these known reagents varies greatly depending on the particular ore or ores being subjected to flotation as well as the flotation conditions. One problem that is also recognized is that the amine collectors used to float silica frequently are not as selective to silica as desirable and also float the valuable mineral with the silica resulting in diminished recoveries of the desired minerals in the tailings.

Thus, a need remains for more efficient methods of removing silica or siliceous gangue from valuable minerals in reverse flotation processes.

SUMMARY OF THE INVENTION

The present invention is a process for the recovery of mineral values by reverse froth flotation comprising subjecting a particulate ore, which contains silica or siliceous gangue and is in an aqueous slurry, to froth flotation in the presence of an amine collector and at least one alkanol amine under conditions such that the silica or siliceous gangue is floated and the mineral values are left in tailings. Additionally, the froth flotation process of this invention utilizes frothers and other flotation reagents known in the art.

The flotation process of this invention is useful in the recovery of various minerals, including oxide minerals, by reverse froth flotation. It is surprising that the use of a small amount of an alkanol amine with amine collectors results in enhanced performance by the amine collector.

DETAILED DESCRIPTION OF ILLUSTRATIVE EMBODIMENTS

The reverse flotation process of this invention is useful in the recovery of mineral values from a variety of ores containing silica or siliceous gangue. An ore herein refers to the mineral as it is taken out of the ground and includes the mineral-containing species intermixed with gangue including the silica gangue. Gangue are those materials which are of little or no value and need to be separated from the mineral values.

Non-limiting examples of silica-containing oxide ores which may be treated using the practice of this invention preferably include iron oxides, nickel oxides, phosphorus oxides, copper oxides and titanium oxides. The treatment of iron-containing and phosphorus-containing ores is particularly preferred. Other types of oxygen-containing minerals having silica gangue which may be treated using the practice of this invention include carbonates such as calcite or dolomite and hydroxides such as bauxite.

Various silica-containing sulfide ores may also be treated by the practice of this invention. Non-limiting examples of sulfide ores which may be floated by the process of this invention include those containing chalcopyrite, chalcocite, galena, pyrite, sphalerite and pentlandite.

As will be recognized by one skilled in the art, various silica-containing ores may be treated by reverse flotation where the silica gangue is floated away from the desired mineral values. Non-limiting examples of silica-containing oxide ores which may be treated using the process of this invention are ores including cassiterite, hematite, cuprite, vallerite, calcite, talc, kaolin, apatite, dolomite, bauxite, spinel, corundum, laterite, azurite, rutile, magnetite, columbite, ilmenite, smithsonite, anglesite, scheelite, chromite, cerussite, pyrolusite, malachite, chrysocolla, zincite, massicot, bixbyite, anatase, brookite, tungstite, uraninite, gummite, brucite, manganite, psilomelane, goethite, limonite, chrysoberyl, microlite, tantalite and samarskite. One skilled in the art will recognize that the reverse froth flotation process of this invention will be useful for the processing of additional ores including oxide ores wherein oxide is defined to include carbonates, hydroxides, sulfates and silicates as well as oxides and sulfide ores.

In addition to the flotation of ores found in nature, the reverse flotation process of this invention is useful in the flotation of oxides and sulfides from other sources. For example, the waste materials from various processes such as heavy media separation, magnetic separation, metal working and petroleum processing often contain oxides and/or sulfides having silica or siliceous gangue that may be recovered using the reverse flotation process of the present invention.

The collectors useful in the flotation of silica in the process of this invention are known in the art and include amine collectors having at least about twelve carbon atoms. Non-limiting examples of such collectors include primary amines, secondary amines, primary ether amines and ether diamines, tallow amines and tall oil fatty acid/amine condensates. Examples of such collectors include propanamine, 3-nonyloxy-; 1,3-propanediamine, N-tridecyloxy-3,1-propanediyl-; the condensate of diethylenetetraamine and tall oil fatty acid; $C_{16}$–$C_{18}$ tallow amine, decylamine, dihexyl amine and the condensate of an excess of fatty acids with diethanolamine.

Alkanol amines are useful in this invention to enhance the flotation of silica in reverse flotation. It is preferred that the alkanol amines used in the practice of this invention are lower alkanol amines. In a preferred embodiment, the alkanol amines correspond to the formula $$(R)_xNH_{(3-x)}$$

wherein x is from one to three and R is separately in each occurrence a $C_{1-6}$ alkanol. In an even more preferred embodiment, the alkanol amine is ethanol amine, diethanol amine, triethanol amine, propanol amine, isopropanol amine, butanol amine, isobutanol amine or mixtures thereof.

The alkanol amines useful in the practice of this invention are available commercially. As will be recognized by one skilled in the art, commercially available alkanol amines will have varying degrees of purity. For example, commercially available diethanol amine may contain varying amounts of ethanol amine and/or triethanol amine. Such alkanol amines are suitable in the practice of the present invention.

The alkanol amines may be added directly to the float cell or may be added to the grinding stage. The preferred time of addition will vary depending on the particular ore being floated, the other reagents present and the processing system being used. The alkanol amines are preferably not pre-mixed with the amine collector prior to addition to the flotation process. They are preferably added to the flotation system separately from the collector. They are also preferably added prior to the addition of the collector. For example, the alkanol amines may be added to the grinding stage.

The amine collector can be used in any concentration which results in the flotation of a sufficient amount of silica or siliceous gangue to give the desired recovery of the desired metal values in the flotation tailings. In particular, the concentration used is dependent upon the particular mineral to be treated, the grade of the ore to be subjected to the froth flotation process and the desired quality of the mineral to be recovered. Additional factors to be considered in determining dosage levels include the amount of surface area of the ore to be treated. As will be recognized by one skilled in the art, the smaller the particle size, the greater the amount of collector reagents needed to obtain adequate recoveries and grades.

Preferably, the concentration of the collector is at least about 0.001 kg/metric ton, more preferably at least about 0.005 kg/metric ton. It is also preferred that the total concentration of the collector is no greater than about 5.0 kg/metric ton and more preferred that it is no greater than about 2.5 kg/metric ton. It is more preferred that the concentration of the collector is at least about 0.005 kg/metric ton and no greater than about 0.100 kg/metric ton. It is generally preferred to start at the lower concentration range and gradually increase the concentration to obtain optimum performance.

The concentration of the alkanol amines useful in this invention is at least that amount sufficient to show a decrease in the amount of valuable mineral inadvertently floated with the silica or siliceous gangue. This amount is preferably at least about 0.001 kg/metric ton of dry solids and no greater than about 0.5 kg/metric ton. A more preferred concentration is at least about 0.01 kg/metric ton and no more than about 0.10 kg/metric ton.

It has been found advantageous in the recovery of certain minerals to add the collector to the flotation system in stages. By staged addition, it is meant that a part of the total collector dose is added; froth concentrate is collected; an additional portion of the collector is added; and froth concentrate is again collected. This staged addition can be repeated several times to obtain optimum recovery and grade. The number of stages in which the collector is added is limited only by practical and economic constraints. Preferably, no more than about six stages are used.

In addition to the amine collectors and alkanol amines useful in this invention, other conventional additives may be used in the flotation process, including other collectors. Examples of such additives include depressants and dispersants. In addition to these additives, frothers may be and preferably are also used Frothers are well-known in the art and reference thereto is made for the purposes of this invention. Non-limiting examples of useful frothers include $C_{5-8}$ alcohols, pine oils, cresols, $C_{1-6}$ alkyl ethers of polypropylene glycols, dihydroxylates of polypropylene glycols, glycol fatty acids, soaps, alkylaryl sulfonates and mixtures thereof.

The pH in flotation systems may be controlled by various methods known to one skilled in the art. A common reagent used to control pH is lime. However, in the practice of this invention, it is also possible to use reagents such as sulfuric acid, hydrochloric acid, potassium hydroxide, sodium hydroxide, sodium carbonate, ammonium hydroxide and other like reagents.

The following examples are provided to illustrate the invention and should not be interpreted as limiting it in any way. Unless stated otherwise, all parts and percentages are by weight.

EXAMPLE 1

Flotation of Iron Oxide Ore

A series of 600-g samples of iron oxide ore from Michigan are prepared. The ore contains primarily magnetite with smaller amounts of hematite, martite and goethite mineral species. The raw feed from which the samples are prepared has been ground to 82 percent minus 75 microns and contains 11.3 percent silica and 46.7 percent iron. Each 600-g sample is individually ground along with 400 g of deionized water in a rod mill at about 60 RPM for two minutes. The resulting pulp is transferred to an Agitair 3000 ml flotation cell outfitted with an automated paddle removal system. Water is added to properly fill the cell volume. The pH of the slurry is left at the natural slurry of the ore which is 6.5 prior to the addition of the alkanol amines of this invention. The alkanol amine, if used, is added and the slurry is allowed to condition for one minute. This is followed by the addition of the collector, as identified in Table I, followed by an additional minute of conditioning. Next, an amount of a polyglycol ether frother equivalent to 5 g per ton of dry ore is added followed by another minute of conditioning.

The float cell is agitated at 900 RPM and air is introduced at a rate of 9.0 liters per minute. Removal of the silica concentrate is performed for ten minutes. Samples of the silica concentrate and product tailings containing the iron are dried, weighed and pulverized for analysis. They are then dissolved in acid, and the iron content determined by the use of a D.C. Plasma Spectrometer. Using the assay data, the fractional recoveries and grades are calculated using standard mass balance formulas. The amount and grade of the iron recovered in the tailings are shown in Table I below.

TABLE I

| Run | Collector | Dosage (kg/metric ton) | Alkanol Amine | Dosage (kg/metric ton) | Fe Rec'd in Tailings | Fe Grade |
|---|---|---|---|---|---|---|
| 1 [1] | $C_9H_{19}O(CH_2)_3NH_2$ | 0.125 | none | none | 0.940 | 0.573 |
| 2 [1] | $C_9H_{19}O(CH_2)_3NH_2$ | 0.250 | none | none | 0.883 | 0.611 |
| 3 [1] | $C_9H_{19}O(CH_2)_3NH_2$ | 0.375 | none | none | 0.798 | 0.634 |
| 4 [1] | $C_9H_{19}O(CH_2)_3NH_2$ | 0.500 | none | none | 0.709 | 0.650 |
| 5 | $C_9H_{19}O(CH_2)_3NH_2$ | 0.250 | DEA [2] | 0.025 | 0.893 | 0.618 |
| 6 | $C_9H_{19}O(CH_2)_3NH_2$ | 0.250 | DEA [2] | 0.050 | 0.907 | 0.627 |
| 7 | $C_9H_{19}O(CH_2)_3NH_2$ | 0.250 | DEA [2] | 0.100 | 0.914 | 0.621 |
| 8 | $C_9H_{19}O(CH_2)_3NH_2$ | 0.250 | DEA [2] | 0.500 | 0.887 | 0.625 |
| 9 | $C_9H_{19}O(CH_2)_3NH_2$ | 0.250 | DEA [2] | 1.000 | 0.836 | 0.639 |
| 10 | $C_9H_{19}O(CH_2)_3NH_2$ | 0.125 | DEA [2] | 0.100 | 0.955 | 0.588 |
| 11 | $C_9H_{19}O(CH_2)_3NH_2$ | 0.375 | DEA [2] | 0.100 | 0.834 | 0.640 |
| 12 | $C_9H_{19}O(CH_2)_3NH_2$ | 0.500 | DEA [2] | 0.100 | 0.769 | 0.658 |
| 13 | $C_9H_{19}O(CH_2)_3NH_2$ | 0.375 | MEA [3] | 0.100 | 0.816 | 0.639 |
| 14 | $C_9H_{19}O(CH_2)_3NH_2$ | 0.375 | IPA [4] | 0.100 | 0.807 | 0.642 |
| 15 | $C_9H_{19}O(CH_2)_3NH_2$ | 0.375 | TEA [5] | 0.100 | 0.827 | 0.640 |
| 16 [1] | DETA Condensate [6] | 0.375 | none | none | 0.823 | 0.617 |
| 17 | DETA Condensate [6] | 0.375 | DEA | 0.100 | 0.843 | 0.619 |
| 18 | DETA Condensate [6] | 0.375 | MEA | 0.100 | 0.840 | 0.623 |
| 19 | DETA Condensate [6] | 0.375 | IPA [4] | 0.100 | 0.835 | 0.614 |
| 20 | DETA Condensate [6] | 0.375 | TEA [5] | 0.100 | 0.847 | 0.620 |
| 21 [1] | $C_{16-18}$ Tallow amine | 0.375 | none | none | 0.744 | 0.657 |
| 22 | $C_{16-18}$ Tallow amine | 0.375 | DEA [2] | 0.100 | 0.765 | 0.655 |
| 23 | $C_{16-18}$ Tallow amine | 0.375 | MEA [3] | 0.100 | 0.760 | 0.661 |
| 24 | $C_{16-18}$ Tallow amine | 0.375 | IPA [4] | 0.100 | 0.756 | 0.659 |
| 25 | $C_{16-18}$ Tallow amine | 0.375 | TEA [5] | 0.100 | 0.764 | 0.658 |
| 26 [1] | $C_{13}H_{27}O(CH_2)_3NH(CH_2)_3NH_2$ | 0.375 | none | none | 0.787 | 0.644 |
| 27 | $C_{13}H_{27}O(CH_2)_3NH(CH_2)_3NH_2$ | 0.375 | DEA [2] | 0.100 | 0.809 | 0.650 |
| 28 | $C_{13}H_{27}O(CH_2)_3NH(CH_2)_3NH_2$ | 0.375 | MEA [3] | 0.100 | 0.801 | 0.654 |
| 29 | $C_{13}H_{27}O(CH_2)_3NH(CH_2)_3NH_2$ | 0.375 | IPA [4] | 0.100 | 0.796 | 0.646 |
| 30 | $C_{13}H_{27}O(CH_2)_3NH(CH_2)_3NH_2$ | 0.375 | TEA [5] | 0.100 | 0.807 | 0.651 |
| 31 [7] | $C_9H_{19}O(CH_2)_3NH_2$ | 0.375 | DEA [2] | 0.100 | 0.814 | 0.642 |
| 32 [8] | $C_9H_{19}O(CH_2)_3NH_2$ | 0.375 | DEA [2] | 0.100 | 0.770 | 0.619 |
| 33 [1] | $C_{12}H_{25}NH_2$ | 0.375 | none | none | 0.738 | 0.653 |
| 34 | $C_{12}H_{25}NH_2$ | 0.375 | DEA [2] | 0.100 | 0.750 | 0.651 |
| 35 [1] | $(C_6H_{13})_2NH$ | 0.375 | none | none | 0.744 | 0.648 |
| 36 | $(C_6H_{13})_2NH$ | 0.375 | DEA [2] | 0.100 | 0.751 | 0.652 |
| 37 [1] | M-210 [9] | 0.375 | none | none | 0.784 | 0.639 |
| 38 | M-210 [9] | 0.375 | DEA [2] | 0.100 | 0.803 | 0.644 |
| 39 | M-210 [9] | 0.375 | $HO(CH_2)_6NH_2$ | 0.100 | 0.788 | 0.648 |
| 40 | M-210 [9] | 0.375 | $HO(CH_2)_6NH_2$ | 0.100 | 0.803 | 0.631 |

[1] Not an embodiment of the invention.
[2] Diethanol amine
[3] Monoethanol amine
[4] Isopropanol amine
[5] Triethanol amine
[6] Condensate of diethylenetetraamine and tall oil fatty acid
[7] pH of slurry adjusted to 5.5 with 1.0 N HCl before collector addition
[8] pH of slurry adjusted to 8.5 with 1.0 N NaOH before collector addition
[9] A condensate of an excess of fatty acids and diethanol amine available commercially from The Dow Chemical Company The data in Table I above shows that the addition of the alkanol amines in the reverse flotation process of this invention results in greater amounts of iron being recovered in the tailings than in similar processes run in the absence of the alkanol amines. For example, comparing Run 2 with Runs 5-8 shows that the addition of small amounts of alkanol amines results in increased iron recovery along with an increase in grade of the iron recovery. This indicates that the addition of a small amount of alkanol amine enhances the effectiveness of the propanamine, 3-nonyloxy- collector used in these runs to collect silica. Examination of other runs in these examples shows that different alkanol amines used with different amine collectors consistently results in enhanced separation of the silica gangue from the desired iron in the process of this invention.

product tailings containing the phosphorus and the concentrate containing the silica gangue are dried, weighed and pulverized for analysis. They are dissolved in acid and the phosphorus ($P_2O_5$) content is determined by a D.C. Plasma Spectrometer. Using the assay data, the recovery and grade of phosphorus ($P_2O_5$) in the tailings are calculated using standard mass balance formulas The results are shown in Table II below.

TABLE II

| Run | Collector | Dosage (kg/metric ton) | Alkanol Amine | Dosage (kg/metric ton) | $P_2O_5$ Rec'd in Tailings | $P_2O_5$ Grade |
|---|---|---|---|---|---|---|
| 1 [1] | $C_{16-18}$ tallow amine | 0.075 | none | none | 0.901 | 0.242 |
| 2 [1] | $C_{16-18}$ tallow amine | 0.150 | none | none | 0.869 | 0.264 |
| 3 [1] | $C_{16-18}$ tallow amine | 0.225 | none | none | 0.824 | 0.294 |
| 4 [1] | $C_{16-18}$ tallow amine | 0.300 | none | none | 0.773 | 0.329 |
| 5 | $C_{16-18}$ tallow amine | 0.225 | DEA [2] | 0.025 | 0.837 | 0.294 |
| 6 | $C_{16-18}$ tallow amine | 0.225 | DEA [2] | 0.050 | 0.846 | 0.297 |
| 7 | $C_{16-18}$ tallow amine | 0.225 | DEA [2] | 0.100 | 0.852 | 0.295 |
| 8 | $C_{16-18}$ tallow amine | 0.225 | MEA [3] | 0.050 | 0.841 | 0.293 |
| 9 | $C_{16-18}$ tallow amine | 0.225 | IPA [4] | 0.050 | 0.837 | 0.296 |
| 10 | $C_{16-18}$ tallow amine | 0.225 | TEA [5] | 0.050 | 0.837 | 0.296 |
| 11 [1] | TETA Condensate [6] | 0.225 | none | none | 0.857 | 0.272 |
| 12 | TETA Condensate [6] | 0.225 | DEA [2] | 0.050 | 0.884 | 0.276 |
| 13 | TETA Condensate [6] | 0.225 | MEA [3] | 0.050 | 0.877 | 0.275 |
| 14 | TETA Condensate [6] | 0.225 | IPA [4] | 0.050 | 0.869 | 0.270 |
| 15 | TETA Condensate [6] | 0.225 | TEA [5] | 0.050 | 0.879 | 0.280 |
| 16 | $C_9H_{19}O(CH_2)_3NH_2$ | 0.225 | none | none | 0.870 | 0.257 |
| 17 | $C_9H_{19}O(CH_2)_3NH_2$ | 0.225 | DEA [2] | 0.050 | 0.889 | 0.255 |
| 18 | $C_9H_{19}O(CH_2)_3NH_2$ | 0.225 | MEA [3] | 0.050 | 0.885 | 0.259 |
| 19 | $C_9H_{19}O(CH_2)_3NH_2$ | 0.225 | IPA [4] | 0.050 | 0.879 | 0.257 |
| 20 | $C_9H_{19}O(CH_2)_3NH_2$ | 0.225 | TEA [5] | 0.050 | 0.886 | 0.254 |
| 21 | TETA Condensate [7] | 0.225 | — | — | 0.856 | 0.283 |
| 22 | TETA Condensate [7] | 0.225 | DEA [2] | 0.050 | 0.879 | 0.287 |
| 23 | TETA Condensate [7] | 0.225 | MEA [3] | 0.050 | 0.871 | 0.285 |
| 24 | TETA Condensate [7] | 0.225 | IPA [4] | 0.050 | 0.869 | 0.282 |
| 25 | TETA Condensate [7] | 0.225 | TEA [5] | 0.050 | 0.875 | 0.285 |
| 26 [8] | $C_{16-18}$ tallow amine | 0.225 | — | — | 0.861 | 0.275 |
| 27 [8] | $C_{16-18}$ tallow amine | 0.225 | DEA [2] | 0.050 | 0.888 | 0.279 |
| 28 [8] | $C_{16-18}$ tallow amine | 0.225 | MEA [3] | 0.050 | 0.880 | 0.273 |
| 29 [8] | $C_{16-18}$ tallow amine | 0.225 | IPA [4] | 0.050 | 0.875 | 0.277 |
| 30 [8] | $C_{16-18}$ tallow amine | 0.225 | TEA [5] | 0.050 | 0.890 | 0.277 |
| 31 | $C_{16-18}$ tallow amine | 0.225 | $HO(CH_2)_6NH_2$ | 0.050 | 0.794 | 0.295 |
| 32 | $C_{16-18}$ tallow amine | 0.225 | $HO(CH_2)_4NH_2$ | 0.050 | 0.823 | 0.290 |

[1] Not an embodiment of the invention
[2] Diethanol amine
[3] Monoethanol amine
[4] Isopropanol amine
[5] Triethanol amine
[6] Condensate of diethylenetetraamine and tall oil fatty acid
[7] Acetate condensate of triethylenetetraamine and tall oil fatty acid
[8] Collector co-added with 0.100 kg/ton refined kerosene

EXAMPLE 2

Reverse Flotation of Silica from Phosphate Ores

A series of 750 g samples of apatite-containing phosphate ore from Florida are prepared. The raw feed from which samples are drawn has a particle size of about 90 percent less than 350 microns and 15 percent less than 37 microns. It contains 26.8 percent $SiO_2$ and 18.7 percent $P_2O_5$. The raw feed has been washed with a sulfuric acid wash to clean the particle surfaces of any organics that may be present due to prior processing stages.

Each sample is transferred to an Agitair 3000 ml flotation cell outfitted with an automated paddle removal system. Sufficient dilution water is added to properly fill the cell volume. The pH of the starting pulp is adjusted to 6.4 with 1.0N NH4OH. The alkanol amine, if used is added, followed by one minute of conditioning. Next, the amine collector is added followed by an additional minute of conditioning. A methylisobutyl carbinol frother is added at 5 g per ton of dry ore.

The float cell is agitated at 900 revolutions per minute and air is introduced at a rate of 9.0 liters per minute. Silica concentrate is removed for ten minutes. The The data in Table II above demonstrates the effectiveness of the present invention in the separation of silica from phosphate ore. In each instance, the addition of a small amount of an alkanol amine increases the ability of the amine collector to remove a silica concentrate from the phosphate tailings leaving a higher recovery of comparable grade phosphorus.

What is claimed is:

1. A flotation process for the separation of silica or siliceous gangue from mineral values wherein the silica or siliceous gangue and mineral values in particulate from in an aqueous slurry are subjected to froth flotation in the presence of an amine collector and an alkanol amine corresponding to the formula $$(R)_xNH_{(3-x)}$$

wherein x is from one to three and R is separately in each occurrence a $C_{1-6}$ hydroxyalkyl moiety, with the proviso that the alkanol amine is not premixed with the amine collector and is added to the flotation process prior to the addition of the amine collector under conditions such that the silica or siliceous gangue is floated and the mineral values are left in the tailings.

2. The process of claim 1 wherein the mineral values comprise an iron oxide ore.

3. The process of claim 1 wherein the mineral values comprise a phosphate ore.

4. The process of claim 1 wherein the alkanol amine is selected from the group consisting of ethanol amine, diethanol amine, triethanol amine, propanol amine, isopropanol amine, butanol amine, isobutanol amine and mixtures thereof.

5. The process of claim 1 wherein silica or siliceous gangue and mineral values are subjected to a grinding step prior to flotation and the alkanol amine is added to the grinding step.

6. The process of claim 1 wherein the alkanol amine is diethanolamine.

7. The process of claim 1 wherein the alkanol amine is monoethanolamine.

* * * * *